United States Patent [19]

Andrew et al.

[11] 4,366,077

[45] Dec. 28, 1982

[54] TEMPER ROLLING FLUIDS

[75] Inventors: Barry E. Andrew, Dromana; Tak W. Mak, Frankston, both of Australia

[73] Assignee: John Lysaght (Australia) Limited, New South Wales, Australia

[21] Appl. No.: 253,836

[22] PCT Filed: Aug. 28, 1980

[86] PCT No.: PCT/AU80/00055

§ 371 Date: Apr. 29, 1981

§ 102(e) Date: Apr. 20, 1981

[87] PCT Pub. No.: WO81/00579

PCT Pub. Date: Mar. 5, 1981

[51] Int. Cl.[3] ..... C10M 1/06

[52] U.S. Cl. ..... 252/49.3; 252/49.5; 72/42; 72/46

[58] Field of Search ..... 252/49.5, 49.3; 72/42, 72/46

[56] References Cited

U.S. PATENT DOCUMENTS 3,425,954 2/1969 Ruzevick et al. ..... 252/390

3,931,020 1/1976 Burgess et al. ..... 252/49.5

*Primary Examiner*—Charles F. Warren

*Assistant Examiner*—Y. Harris-Smith

*Attorney, Agent, or Firm*—LeBlanc, Nolan, Shur & Nies

[57] ABSTRACT

The invention provides a composition for application to a metal surface, the composition comprising an inorganic nitrite, a benzoate and a carbonate in aqueous solution. The composition may advantageously be used as a lubricant or coolant during metal working, for example temper rolling, and for protection of coil or sheet packs of steel against corrosion.

23 Claims, No Drawings

TEMPER ROLLING FLUIDS

TECHNICAL FIELD

This invention relates to a fluid composition suitable for application to a metal surface. The composition may advantageously be used as a lubricant or coolant during metal working or for protection of coil or sheet packs of steel against corrosion.

The invention further relates to methods of use of the fluid composition.

During certain metal working operations it is usual to supply a fluid to the surface of the metal to be worked to reduce friction and also to cool the work piece. In a number of cases, for example, during temper rolling and high speed cutting of steel, aqueous fluids are preferred on the basis of their cleaning action.

The present invention will herein be described with particular reference to the example of temper rolling fluids but will be understood to be applicable to other aqueous metal working fluids such as cutting fluids.

BACKGROUND ART

In the past temper rolling fluids have generally contained a nitrite salt to inhibit corrosion and one or more organic amine compounds, for example triethanolamine, to serve as a secondary corrosion inhibitor, and to act as an ion complexant.

Such fluids suffer from a number of disadvantages, including:

1. A tendency to foam, with consequent problems during metal working.
2. A tendency to hygroscopicity resulting in a complaint known as "wet pack" in respect of coil or sheet packs of steel which manifests itself in an unsightly appearance of the steel surface and which is detrimental to paintability.
3. Complaints relating to welder tip life by users of the steel.
4. Significant problems in waste disposal and water treatment at rolling mills, caused by the inclusion in such fluids of amine compounds.
5. Because of the problems in pollution control which arise from previously used fluids, it has been practised to recirculate rolling fluids and this in turn has given rise to problems with corrosion inhibition, product cleanliness and degradation of the fluid.

It is an object of the present invention to provide a fluid the use of which avoids or at least ameliorates some or all of those problems. The present invention provides a rolling fluid which avoids most of the disadvantages previously described while having substantially similar or superior performance to known rolling fluids in most other respects. More particularly, compositions according to the present invention do not contain amines and after use are more acceptable for waste discharge into the environment either with or without waste treatment. The composition possesses a mild cleaning action and results in more effective cleaning of steel strip during temper rolling and less susceptibility to "wet pack" formation in comparison with previously used fluids, resulting in improved paintability of the steel surface. Composition according to the invention may be made suitable for use with steel intended for food grade application. Rolling fluids according to preferred embodiments are less susceptible to excessive foaming during use than previously used fluids and may be made at lower raw materials cost per unit volume and with lower waste discharge pollution loadings. The fluids may be applied at lower surface loadings than has been usual with fluids hitherto in use and inhibit corrosion in steel after unpacking when the steel is exposed to high humidity.

DISCLOSURE OF INVENTION

According to a first aspect the invention consists in a composition for application to a metal surface comprising:

an inorganic nitrite
a benzoate
a carbonate dissolved in aqueous solution.

According to a second aspect the invention consists in a composition according to the first aspect further comprising a glycol or polyol.

According to a third aspect the invention consists in a composition according to the first or second aspect further comprising a surfactant.

According to a fourth aspect the invention consists in the method of treating steel by applying to the surface thereof a solution according to any one of the preceding aspects.

BEST MODE OF CARRYING OUT THE INVENTION

Preferred embodiments of the invention will now be described with reference to the accompanying examples.

A preferred embodiment of the invention employs as a concentrate a solution in water having the composition shown in Table 1.

TABLE 1

| Component | Concentration in concentrate (g/L) |
|---|---|
| Sodium nitrite | 120 |
| Sodium carbonate | 20–40 |
| Sodium benzoate | 10 |
| Ethylene glycol | 45 |
| Fatty Alcohol Ethoxylate | 0.1 |

When intended for use as a temper rolling fluid the concentrate is typically diluted with water to a 5% V/V working solution although working solutions of 2% V/V are effective.

Formulations having concentrations in the range shown in Table 2 have been found to be effective.

TABLE 2

| Component | Concentration concentrate (g/L) |
|---|---|
| Sodium nitrite | 108–132 |
| Sodium carbonate | 18–44 |
| Sodium benzoate | 9–11 |
| Ethylene glycol | 40–50 |
| Fatty Alcohol Ethoxylate | 0.09–0.11 |

Of the components shown in Tables 1 and 2 only a nitrite, a carbonate and a benzoate are essential.

It is believed that the sodium nitrite functions as a primary corrosion inhibitor. Other alkali metal nitrites, for example potassium nitrite, could be substituted for sodium nitrite and the sodium salt is selected primarily for economic reasons. The sodium carbonate and sodium benzoate, function as a buffer system to maintain a pH in the concentrate in the range of from pH 8.5 to pH 11.5 and more preferably of pH 10.5 to pH 11.5 in the working solution. However it is believed that the sodium carbonate in addition functions as a weak corrosion inhibitor and also contributes to humectant control. Moreover the sodium benzoate appears also to function as a secondary corrosion inhibitor. Alkali metal carbonates or benzoates other than sodium salts may be used, for example potassium salts. One or more glycol or polyol for example glycerol or ethylene glycol are preferably included and are believed to serve as additional humectant controllers.

A surfactant and preferably a fatty alcohol ethoxylate in the range of 5 to 20 parts per million, is desirably added in order to stabilize the surface tension characteristics of the solution without causing excessive foaming of the solution during its use. Alternatively, higher concentrations of low-foaming surfactants can be employed up to 100 ppm. For preference the working solution (at 5% V/V on the concentrate) has a surface tension of from 40–50 dynes/cm.

When the rolling fluid is to be applied to steels to be used in food grade applications then desirably food grade or equivalent constituents should be used. The formulation does not include added organic nitrogen compounds such as amines. It will be understood that no particular care is taken to exclude trace quantities of organic nitrogen compounds which may occur as impurities in other components but such quantities would be negligible in commercially used grades of the constituents employed.

It will also be understood that while salts other than the sodium salt of the benzoate may be used, the sodium salt is strongly preferred in the case of temper rolling fluids not only because of economic considerations, but also because improved control of humectant properties is obtained.

For preference the proportion of carbonate and benzoate, to each other and to the nitrite may be varied to achieve a buffering of the pH within the range pH 8.5 to pH 11.3 in the concentrate and more preferably to achieve buffering of the working solution at a pH 10.5 to pH 11.5. However because each of those constituents contributes to the effectiveness of the solution in other respects the concentration ratios of those components described in Table I are very highly preferred.

In use a working solution according to the invention is applied, for example by spray, preferably in the temperature range of from 20° to 40° C. to steel strip at the temper mill.

By way of further example, there will be described the results of comparative trials in which a commercially available amine containing rolling fluid concentrate (A1) was used as a control. A 5% working solution (A2) was made therefrom by dilution with water in accordance with usual practice.

A solution having a composition according to Table 1 was prepared (concentrate B1). A 5% working solution (B2) was made therefrom by dilution with water.

Two 20 tonne steel coils were temper rolled in succession on one day, the first (coil 1) using solution B2, and the second (coil 2) using control solution A2, as the temper rolling fluid.

Both coils were from the same annealing charge. Each coil was cut in two at the mill. One portion of each was retained for storage testing over 5 months.

As far as practicable on each inspection coils were sampled at mid coil position and tested for surface loadings edge-to-edge.

Sampling of coils at the shearline immediately after rolling showed that even at this stage solution B2 according to the invention appeared to produce a visibly cleaner surface than did control solution A2. Analysis of surface loadings (Table 3) showed that based on turbidity results solution (B2) was giving a product approximately twice as clean as when solution A2 was used. In samples treated with B2 according to the invention, surface loadings of sodium and nitrite were advantageously approximately 30 to 50% of loadings obtained with solution A2.

The second inspection and sampling was carried out at the shearline two months later. No evidence of corrosion except at unprotected coil edges could be seen and the condition of both coils was agreed to be satisfactory. It was noticeable, however, that the coil passivated with solution B2 according to the invention had a uniform dry appearance, whereas the coil treated with control solution A2 had a slick appearance which could almost qualify as a "wet pack". Both coils were repacked for further storage.

After a total of five months storage, the coils were again inspected and sampled at the slitter prior to oiling for sale. Both coils were free of corrosion and the coil treated with solution B2 was still dry. The coil treated with solution A2 (control) appeared to have undergone absorption and desorption of moisture and the surface appeared to be much dirtier than the surface of the coil treated according to the invention.

One anomaly which became apparent in the course of investigation was that the turbidity measurements on the coil treated with solution A2 decreased whereas those from the coil treated will solution B2 were reasonably stable. This is considered to be due to the absorption and desorption of moisture in the coil treated with solution A2 giving rise to a flocculating action with particulate matter; the resultant larger particles being more readily visible and the strip appearing dirtier. Paradoxically, however, cleanliness (as measured by turbidity) increases as the larger particles scatter less light and hence a lower turbidity is recorded.

A mill trial was run on 10 coils temper rolled using a 5% working solution (B3). Results of sampling during this trial are shown in Table 5.

The results from the two experimental coils and the 10 full scale trials show that very consistent low surface loadings are achieved using solutions according to the invention (Table 3). A comparison with results obtained during study of surface loadings when solution A2 was used indicate that lower and more consistent loadings are attained, with solutions of the invention.

TABLE 3

| | | Surface Loadings |
|---|---|---|
| Solution B2 according to the invention | | |
| Sodium | Range | 1.2–3.2 mg/m$^2$ |
| | Average | 2.0 mg/m$^2$ |
| Nitrite | Range | 1.0–6.6 mg/m$^2$ |
| | Average | 3.1 mg/m$^2$ |
| Ethylene/glycol | Range | 0.5–2.6 mg/m$^2$ |
| | Average | 1.1 mg/m$^2$ |
| Benzoate | Range | 0.2–0.4 mg/m$^2$ |
| | Average | 0.2 mg/m$^2$ |
| Control Solution A2 According to prior art | | |
| Sodium | Range | 3.2–41 mg/m$^2$ |
| | Average | 9.5 mg/m$^2$ |
| Nitrite | Range | 4.3–35 mg/m$^2$ |
| | Average | 10.1 mg/m$^2$ |

TABLE 3-continued

| | | Surface Loadings |
|---|---|---|
| Triethanolamine | Range | 2-60 mg/m$^2$ |
| | Average | 11.2 mg/m$^2$ |
| Acetate | Range | 1-28 mg/m$^2$ |
| | Average | 8.4 mg/m$^2$ |

These results indicate far better uniformity of surface loadings when solutions of the invention are used as well as lower surface loadings. The dilution of solution A1 to 2% levels in order to achieve lower surface loadings has been found to give unsatisfactory results with the prior art concentrate.

Some of the materials of the present invention (e.g., ethylene glycol and benzoate) could barely be detected on the surface of product even with highly sensitive liquid chromatographic techniques sensitive to better than 1 ppm of benzoate.

It has also been found that use of compositions according to the invention improve resistance of treated steel to corrosion in high humidities. Samples of trial coils after 5 months storage were placed in a humidity cabinet of 93% R.H. overnight. It was found that the solution A2 treated metal had rusted whereas the solution B2 passivated metal was clean; in fact the solution B2 treated panel lasted for five days under the best condition before visible rust became evident.

The test was repeated to confirm the results. It is thought that the marked difference in corrosion performance can be explained as follows:

After nitrite on the surface is exhausted by air access sheet rolled using control solution A2 will have a surface loading of acetate of approximately 2-5 mg/m$^2$ in relation to the samples under discussion. It has been shown that acetate is aggressive to steel and has high water absorption characteristics. After nitrite is exhausted on sheet rolled with solution B2 small surface loadings of carbonate and benzoate (0.2-1 mg/m$^2$) will remain. These components have low water absorption characteristics and in addition benzoate appears to act as a general inhibitor. Benzoate is also apparently more effective as an inhibitor with free oxygen access.

This corrosion suppression is of particular advantage to end users of unoiled coil such as drumstock manufacturers. Whilst stored in coil form, the passivation will be equivalent when either prior art solution or those according to the invention are used. In loose sheet form during subsequent processing, superior corrosion resistance is exhibited by sheet treated according to the invention particularly in high humidity conditions.

In addition, the lower surface loadings and generally improved cleanliness results in improved paintability and paint adhesion.

It has been found that sheet rolled with recirculated prior art solution is considerably dirtier than fresh solution, since particulate carbon in recirculated solution is redeposited on the strip during temper rolling. In the past approximately 60% of all product has been rolled with recirculated solution in order to minimize waste disposal due to problems with pollutant loadings. The solution of the invention need not be recirculated resulting in a substantial improvement of overall product cleanliness for unoiled and oiled uncoated product. In addition, it has been observed that the tendency towards emulsification of an oil, irrespective of its composition, is far worse with recirculated solution. This appears to be due to the presence of dirt in conjunction with the triethanolamine component of prior art solutions and that tendency is avoided by use of non-recirculated solutions according to the invention.

INDUSTRIAL APPLICABILITY

The present invention provides the metal rolling industries with:

1. In-coil protection similar to that given by the prior art but at loadings of 1-3 mg/m$^2$ instead of 5-10 mg/m$^2$ of nitrite.

2. Far better corrosion resistance, particularly with unoiled stock, after sheet is unpacked than is provided by the prior art.

3. The elimination of organic nitrogen components from such fluids results in fewer problems in water treatment of temper mill wastes, and enables the use of non-recirculated solution.

4. Since recirculation of solution is unnecessary a significant improvement of overall cleanliness of uncoated sheet is obtainable.

5. The use of lower surface loadings eliminates or substantially reduces wet pack occurrences and extends welder tip life.

Substantially similar advantages may be obtained when fluids according to the invention are used as coolants or lubricants in other fields of metal working.

TABLE 4

| | | | Surface Analysis - 20 tonne Production Trial | | | | | |
|---|---|---|---|---|---|---|---|---|
| Inspection Date | Coil No. | Temper Rolling Fluid | Sample Position | Turbidity+ JTU/0.1 m$^2$ | Sodium mg/m$^2$ | Nitrite mg/m$^2$ | Ethylene Glycol, mg/m$^2$ | Benzoate mg/m$^2$ |
| 0 | 8909-2 | A2 | Edge | 190 | 4.0 | 5.0 | Not Tested | Not tested |
| | | | Centre | 230 | 3.9 | 4.4 | Not Tested | Not tested |
| | | | Edge | 220 | 4.0 | 4.8 | Not Tested | Not tested |
| 0 | 8908-2 | B2 | Edge | 130 | 1.7 | 2.3 | 3.8 | 0.7 |
| | | | Centre | 50 | 1.5 | 2.3 | 2.0 | 0.7 |
| | | | Edge | 140 | 1.8 | 2.1 | 2.0 | 0.8 |
| 60 days | 8909-1 | A2 | Edge | 160 | 5.7 | 10.5 | Not Tested | Not Tested |
| | | | Centre | 65 | 5.0 | 6.5 | Not Tested | Not Tested |
| 60 days | 8908-1 | B2 | Edge | 110 | 2.0 | 2.7 | Not Tested | Not Tested |
| | | | Centre | 15 | 1.7 | 2.4 | Not Tested | Not Tested |
| 60 days | 8908-2 | B2 | Edge | 225 | 2.1 | 2.6 | Not Tested | Not Tested |
| | | | Centre | 50 | 1.8 | 2.1 | Not Tested | Not Tested |
| 150 days | 8909-1 | A2 | Edge | 70 | 4.8 | 7.5 | Not Tested | Not Tested |
| | | | Centre | 50 | 4.8 | 8.5 | Not Tested | Not Tested |
| | | | Edge | 100 | 5.5 | 7.5 | Not Tested | Not Tested |
| 150 days | 8908-1 | B2 | Edge | 70 | 1.5 | 2.0 | 1.2* | 0.5* |
| | | | Centre | 50 | 1.7 | 2.5 | | |

TABLE 4-continued

| Surface Analysis - 20 tonne Production Trial | | | | | | | | |
|---|---|---|---|---|---|---|---|---|
| Inspection Date | Coil No. | Temper Rolling Fluid | Sample Position | Turbidity+ JTU/0.1 $m^2$ | Sodium $mg/m^2$ | Nitrite $mg/m^2$ | Ethylene Glycol, $mg/m^2$ | Benzoate $mg/m^2$ |
| | | | Edge | 70 | 1.8 | 2.5 | | |

*Due to the low levels present a repeat strip of 0.3 $m^2$ from the centre of samples was necessary
+It has been shown by studies of gravimetric recovery verses turbidity that turbidity is a value proportional to surface particulate contamination.

TABLE 5

| Surface Analysis - Large Scale Trial Using Working Solution 5% V/V of Concentrate of Table 1 | | | | | | |
|---|---|---|---|---|---|---|
| Coil No. | Position | Turbidity+ JTU/0.1 $m^2$ | Sodium $mg/m^2$ | Nitrite $mg/m^2$ | Ethylene Glycol $mg/m^2$ | Benzoate $mg/m^2$ |
| 1 | Edge | 20 | 2.6 | 3.9 | 1.0 | 0.3 |
| | Centre | 20 | 1.8 | 3.2 | 0.8 | 0.3 |
| 2 | Edge | 20 | 2.8 | 6.6 | 0.6 | 0.4 |
| | Centre | 20 | 3.2 | 4.8 | 0.9 | 0.4 |
| 3 | Edge | 65 | 1.4 | 1.0 | 2.1 | 0.2 |
| | Centre | 30 | 1.4 | 1.1 | 1.1 | 0.2 |
| 4 | Edge | 50 | 1.8 | 3.0 | Not Tested | Not Tested |
| | Centre | 65 | 2.0 | 2.8 | Not Tested | Not Tested |
| 5 | Edge | 20 | 2.1 | 3.6 | Not Tested | Not Tested |
| | Centre | 20 | 1.7 | 2.9 | Not Tested | Not Tested |
| 6 | Edge | Not Tested** | 2.1 | 5.1 | 0.5 | 0.2 |
| | Centre | Not Tested | 2.0 | 5.6 | 0.5 | 0.2 |
| 7 | Edge | Not Tested | 1.7 | 3.8 | 0.5 | 0.2 |
| | Centre | Not Tested | 2.0 | 3.8 | 0.5 | 0.2 |
| 8 | | 80 | 2.4 | 2.3 | 1.8 | 0.2 |
| 9 | | 95 | 2.4 | 2.3 | 1.5 | 0.2 |
| 10 | | 20 | 1.8 | 2.3 | 1.1 | 0.2 |
| Range | | 20–430 | 1.2–3.2 | 1.0–6.6 | 0.5–2.6 | 0.2–0.4 |
| Average | | 90 | 2.0 | 3.1 | 1.1 | 0.2 |

**Oiled Sample
+It has been shown by studies of gravimetric recovery verses turbidity that turbidity is a value proportional to surface particulate contamination.

The claims defining the invention are as follows:

1. A composition for application to a metal surface and characterized in that said composition comprises:
an inorganic nitrite
a benzoate, and
a carbonate
dissolved in aqueous solution.

2. A composition for application to a metal surface and characterized in that said composition comprises:
an inorganic nitrite
a benzoate,
a carbonate, and
a glycol or polyol;
dissolved in aqueous solution.

3. A composition for application to a metal surface and characterised in that said composition comprises:
an inorganic nitrite
a benzoate,
a carbonate, and
a glycol or polyol;
a surfactant
dissolved in aqueous solution.

4. A composition according to any one of claims 1 to 3 wherein said inorganic nitrite is an alkali metal nitrite.

5. A composition according to any one of claims 1 to 3 wherein said benzoate is an alkali metal benzoate.

6. A composition according to any one of claims 1 to 3 wherein said carbonate is an alkali metal carbonate.

7. A composition according to claim 4 wherein said inorganic nitrite is sodium nitrite.

8. A composition according to claim 5 wherein said benzoate is sodium benzoate.

9. A composition according to claim 6 wherein said carbonate is sodium carbonate.

10. A composition according to claim 1 further comprising ethylene glycol.

11. A composition according to any one of claim 1 or claim 10 further comprising a fatty acid ethoxylate.

12. A composition according to any one of claims 1 to 3 wherein the ratio of concentration of the carbonate to benzoate is selected to buffer the solution of a pH of from pH 8.0 to pH 11.5.

13. A composition according to any one of claims 1 to 3 wherein the carbonate is sodium carbonate, the benzoate is sodium benzoate, and the ratio by weight of sodium carbonate to sodium benzoate is in the range 2:1 to 4:1.

14. A composition according to any one of claims 1 to 3 wherein the nitrite is sodium nitrite the benzoate is sodium benzoate, and the ratio by weight of sodium nitrite to sodium benzoate is in the range of from 9:1 to 15:1.

15. A composition according to claim 14 wherein the ratio by weight of sodium nitrite to sodium benzoate is in the range 6:1 to 12:1.

16. A composition according to any one of claims 1 to 3 comprising less than 132 g/l of sodium nitrite.

17. A composition according to claim 3 comprising as solute per liter of solution of
no more than 132 grams of soidum nitrite
no more than 11 grams of sodium benzoate
no more than 44 grams of sodium carbonate
no more than 50 grams of ethylene glycol
no more than 0.11 grams of a surfactant.

18. A composition according to claim 17 when diluted substantially to 5% V/V with water and having a pH of 10.5 to 11.5 and a surface tension of 40–50 dynes/cm.

19. The method of treating steel comprising the steps of applying to the surface thereof a composition according to any one of claims 1 to 3.

20. The method according to claim 19 when said composition is applied so as to result in a surface loading of 1.0 to 6.6 mg nitrite per meter of steel surface.

21. The method according to claim 19 wherein said composition is applied by being sprayed onto said surface.

22. The method according to claim 19 wherein said composition is applied to said steel prior to or during metal working as a lubricant or coolant.

23. The method according to claim 22 wherein said composition is applied to said steel prior to or during temper rolling as a temper rolling fluid.

* * * * *

UNITED STATES PATENT AND TRADEMARK OFFICE

CERTIFICATE OF CORRECTION

PATENT NO. : 4,366,077

DATED : December 28, 1982

INVENTOR(S) : Barry E. Andrew and Tak W. Mak

It is certified that error appears in the above—identified patent and that said Letters Patent is hereby corrected as shown below:

Column 8, line 64 change "soidum" to --sodium--.

Signed and Sealed this

*Twenty-second* Day of *March 1983*

[SEAL]

*Attest:*

GERALD J. MOSSINGHOFF

*Attesting Officer*

*Commissioner of Patents and Trademarks*